US008763679B2

(12) United States Patent
Albrecht-Früh et al.

(10) Patent No.: US 8,763,679 B2
(45) Date of Patent: Jul. 1, 2014

(54) CASTING ROLL FOR A TWO-ROLL CASTING DEVICE AND TWO-ROLL CASTING DEVICE

(75) Inventors: Ulrich Albrecht-Früh, Krefeld (DE); Roland Sellger, Ratingen (DE); Johann Wilhelm Schmitz, Baesweiler (DE); Reiner Kopp, Aachen (DD); Jörg Lauscher, Bremen (DE); Martin Franzke, Aachen (DE)

(73) Assignee: Outokumpu Nirosta GmbH, Krefeld (DE)

( * ) Notice: Subject to any disclaimer, the term of this patent is extended or adjusted under 35 U.S.C. 154(b) by 723 days.

(21) Appl. No.: 12/523,239

(22) PCT Filed: Jan. 24, 2008

(86) PCT No.: PCT/EP2008/050795

§ 371 (c)(1),
(2), (4) Date: Mar. 9, 2010

(87) PCT Pub. No.: WO2008/090192

PCT Pub. Date: Jul. 31, 2008

(65) Prior Publication Data

US 2010/0300643 A1 Dec. 2, 2010

(30) Foreign Application Priority Data

Jan. 24, 2007 (DE) ..... 10 2007 003 548

(51) Int. Cl.
*B22D 11/06* (2006.01)

(52) U.S. Cl.
USPC ..... 164/428; 164/480

(58) Field of Classification Search
USPC ..... 164/427, 428, 442, 448, 480
See application file for complete search history.

(56) References Cited

U.S. PATENT DOCUMENTS

| | | | | | |
|---|---|---|---|---|---|
| 5,701,948 | A * | 12/1997 | Strezov et al. | ..... | 164/480 |
| 5,788,824 | A | 8/1998 | Catonne et al. | ..... | 205/210 |
| 7,604,039 | B2 * | 10/2009 | Nikolovski et al. | ..... | 164/428 |

FOREIGN PATENT DOCUMENTS

| | | | | |
|---|---|---|---|---|
| EP | 0801154 | | 10/1997 | |
| JP | 58-116956 | A * | 7/1983 | ..... B22D 11/06 |
| JP | 58116956 | | 7/1983 | |
| JP | 61159247 | | 7/1986 | |
| JP | 1170553(A) | | 7/1989 | |
| JP | 2003191055 | | 7/2003 | |
| WO | 9717478 | | 5/1997 | |
| WO | 0064612 | | 11/2000 | |
| WO | 0230594 | | 4/2002 | |

OTHER PUBLICATIONS

International Search Report for International Application No. PCT/EP2008/050795, dated May 23, 2008.

* cited by examiner

*Primary Examiner* — Kevin P Kerns
(74) *Attorney, Agent, or Firm* — The Webb Law Firm

(57) ABSTRACT

A casting roll for a two-roll casting device for the casting of metallic strip from a metal melt, in particular a steel melt, includes a roll body, on a casing surface of which a coating consisting of a coating material is applied by thermal spraying, which has a higher degree of hardness than the roll body. The casting roll according to the invention and the two-roll casting device, while easy to manufacture, has not only a long service life, but also allows for the manufacture of cast strips of optimum quality. This is achieved by the fact that the free surface of the coating, after thermal spraying, has a peak number RPc of at least 10 $cm^{-1}$.

13 Claims, 2 Drawing Sheets

CASTING ROLL FOR A TWO-ROLL CASTING DEVICE AND TWO-ROLL CASTING DEVICE

CROSS-REFERENCE TO RELATED APPLICATIONS

This application is a National Phase Application of International Application No. PCT/EP2008/050795, filed on Jan. 24, 2008, which claims the benefit of and priority to German patent application no. DE 10 2007 003 548.0-24, filed on Jan. 24, 2007. The disclosures of the above applications are incorporated herein by reference in their entirety.

FIELD OF THE INVENTION

The invention relates to a casting roll for a two-roll casting device for the casting of metallic strip from a metal melt, in particular a steel melt, with a roll body on the casing surface of which a coating consisting of a coating material is applied by thermal spraying which has a higher degree of hardness than the roll body. The invention likewise relates to a two-roll casting device which is equipped with such casting rolls.

BACKGROUND

When casting metal melts, two casting rolls arranged axially parallel and cooled internally rotate in counter-rotation to one another in devices, also designated as "twin-roller casting machines", said casting rolls delimiting between them the longitudinal sides of a casting gap. Into this casting gap, in each case, as much molten melt is cast such that what is referred to as a "melt pool" forms above the casting gap.

The melt which passes from this melt pool onto the casting rolls solidifies in each case to form a shell, which is then conveyed by the respective casting roll into the casting gap. The shells are then pressed against one another in the casting gap, such that the cast strip is formed from them and the melt enclosed between them. The strip continuously emerging in this way from the casting gap is drawn off, cooled, and conveyed onwards for further processing.

In order to provide good thermal conductivity, the casting rolls have as a rule a roll body, which at least in the area of its circumferential surfaces consists of a copper alloy. In practical operation, however, the casing surface of the casting rolls which comes in contact with the metal melt is subjected to severe mechanical and thermal loading. This applies in particular if the metal melt to be cast is a steel alloy. For this reason, casting rolls used for the casting of steel are, as a rule, provided on their casing surface with a coating, which has a greater hardness than the other material of the casting roll.

A method for the production of such a coating on a roll body of a casting roll consisting of copper is known from EP 0 801 154 B1. According to the known method, while respecting specific method steps, the circumferential surface consisting of copper of the casting roll is coated with a nickel layer by electrolytic means. In this way, the finished casting roll is coated with a wear-resistant layer on its casing surface which comes in contact with the melt, of which the hardness is perceptibly higher than that of the roll body in the uncoated state. In practical operation, the nickel layer protects the copper rolls from mechanical damage and reduces their thermal load.

Practical experience has shown that crack-free strips can only be cast with casting rolls which have adequately rough casing surfaces. Accordingly, the casing surface of casting rolls composed for example in the manner described heretofore, with a nickel layer applied which provides protection against excessive wear, is specifically shaped, usually by sand-blasting, shot-blasting, or comparable methods, in such a way that an adequate degree of roughness is achieved on it. In practice, surfaces are produced on the casting rolls of which the peak number (i.e., peak count) RPc, determined in accordance with the StahlEisen test specification SEP 1940 (3)/prEN 10049, of surfaces which are treated by shot-blasting lies in the range from 4-7 $cm^{-1}$. The effort and expenditure associated with this coating and surface treatment is, however, considerable, and incurs high additional costs.

In order to reduce this expenditure and effort, and at the same time to improve the service life of the casting rolls, it has been proposed in JP 2003 191055 A that a coating 300-1000 μm thick be applied onto the casing surfaces of the roll bodies by flame spraying. With this thermal spraying method the spray medium, present in the form of wire, bar, or powder, is melted by means of a suitable heat source, which can be, for example, an oxyacetylene flame, and is then sprayed onto the casting roll surface to be coated with compressed air or another gas.

One advantage of the method of coating roll bodies of a casting roll known from JP 2003 191055 A is the fact that by means of flame spraying even especially hard metal alloys with high melting points can be applied onto the casing surface which is to be coated. It is likewise possible, by means of a suitable thermal spray process, to apply metal powder or ceramic particles optimally composed in respect of their hardness and wear resistance onto the surface which is to be coated.

The coating obtained from JP 2003 191055 has improved wear resistance with simplified manufacture. Practical investigations have revealed, however, that strips cast with casting rollers coated in this way do not fulfill the requirements imposed with regard to their surface quality and casting microstructure with the required degree of operational reliability.

SUMMARY OF THE INVENTION

In general, an aspect of the invention is to provide a casting roll and a two-roll casting machine which, which while being easy to manufacture, has not only a long service life but also allows the manufacture of strips cast with optimum quality.

With respect to a casting roll, this aspect is achieved in that the free surface of the coating, after thermal spraying, has a peak number RPc of at least 10 $cm^{-1}$.

According to the invention, the thermal spraying is carried out in such a way that the casting roll in the finished coated state has in the area of its casing surface formed by the free surface of the coating, with a stochastic distribution of the peaks, a peak number RPc which is perceptibly greater than the peak number RPc which is obtained in a conventional manner with casting rolls subsequently treated by shot-blasting or sand-blasting. Surprisingly, it has turned out that by this measure it is already possible to obtain an optimum casting microstructure of the cast strip. Due to the comparatively large number of peaks which are present with the treatment according to the invention of the surface of the coating, more uniform heat dissipation is achieved from the melt passing onto the casting rolls than with known casting rolls. In this way, a uniformly progressing solidification front is formed in the melt in contact with the casting rolls, which ensures the creation of a likewise correspondingly uniformly formed casting microstructure.

At the same time, the high number of peaks RPc guarantees that the shells forming on the casting rolls due to the steel which is solidifying at that point, when emerging from the casting gap formed between the casting rolls of the two-roll casting machine, becomes perfectly detached from the respective casting roll. In this situation, the troughs which are present between the individual peaks on the surface of the coating formed according to the invention acquire a particular significance. In practical casting operation this consists of the fact that a gas cushion is formed there from the gas which remains adhering on the casting roll during its rotation in the direction of the casting gap, which prevents an intensive positive-fit jamming of the solidifying steel with the casing surface of the casting roll.

Accordingly, the aspect referred to above in relation to a two-roll casting machine for the casting of cast strip from a metal melt, in particular a steel melt, equipped with two casting rolls arranged axially parallel and rotating in counter-rotation to one another, which delimit between them a casting gap, through which the cast strip emerges, is achieved in that the casting rolls are formed in the manner according to an embodiment the invention.

Optimum casting results can be obtained with a casting roll according to the invention if the peak number RPc amounts to at least 10 $cm^{-1}$ and a maximum of 40 $cm^{-1}$.

With regard to the effort and expenditure associated with the thermal spraying, and the dimensional consistency of the coating applied according to the invention onto the casting roll body, it has proved advantageous if the thickness of the coating is restricted to a maximum of 200 μm, in particular 75-180 μm.

In principle, all materials capable of being sprayed (metals, ceramics, hard materials), which individually or in combination with one another have an adequate hardness and wear resistance, are suitable for the production of the coating according to the invention.

The thermal spraying, used to apply the coating which protects against premature wear, in this situation allows a material to be used for the coating which in each case is optimized for the individual application purpose and the individual wear situation.

As a result, for example, hard metal materials can be applied onto the roll body of the casting roll by thermal spraying which guarantee a particularly high degree of hardness and wear resistance of the coating. These consist, as a rule, of a high proportion of very hard carbides, with high melting temperatures, which are bound into a matrix of Fe, Co, or Ni. This may involve individual carbide types, such as tungsten carbide, or carbides of various hard materials (W, Ti, Ta, Nb). In addition, chromium or boron carbides, and compounds of these hard materials with nitrogen, also come into consideration.

In addition to this, a coating of CrNi or comparable alloys can be used which have a high chemical resistance with good wear resistance.

By the addition of ceramic particles, the hardness of the coating and therefore its service life can be further increased.

DESCRIPTION OF THE DRAWINGS

The invention is explained in greater detail hereinafter on the basis of drawings representing an embodiment. These show, in each case diagrammatically and not to scale.

Figure 1:
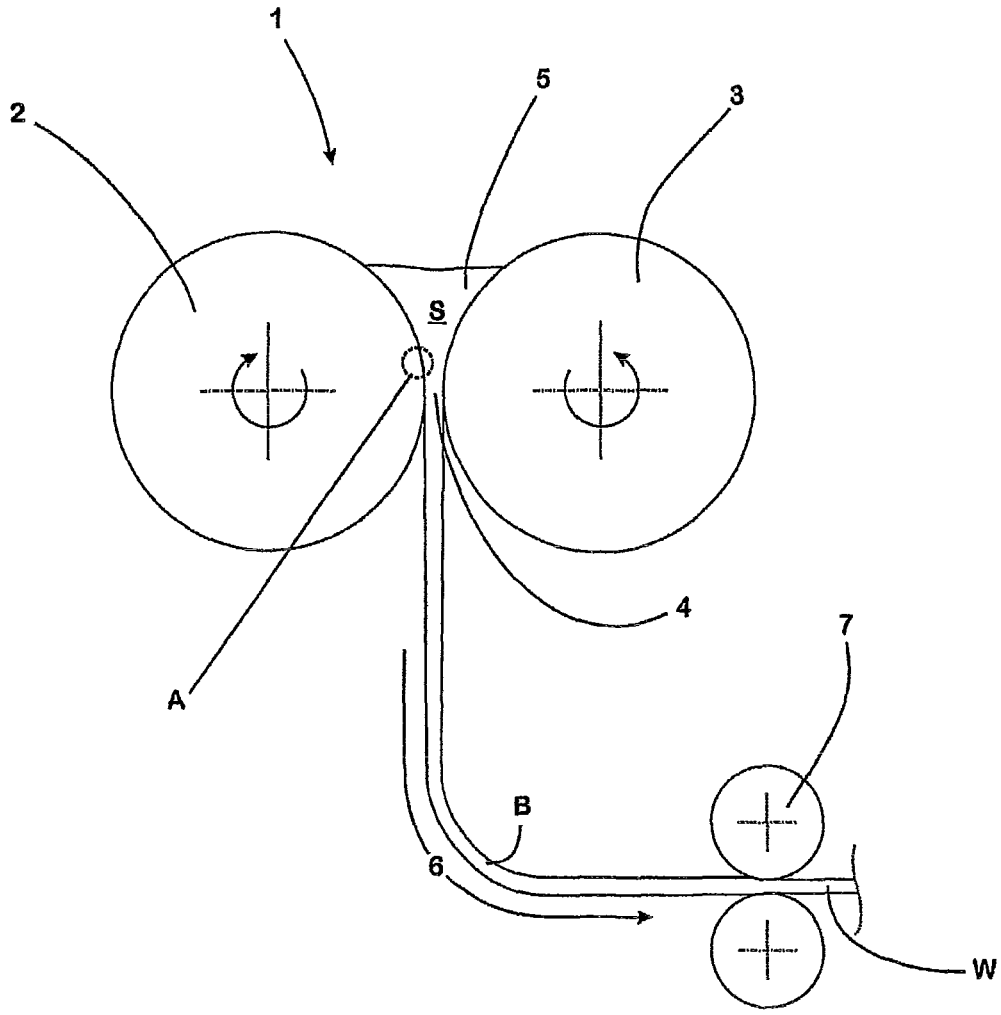
FIG. 1 A device for the casting of steel melt to cast strip, in a side view.
Figure 2:
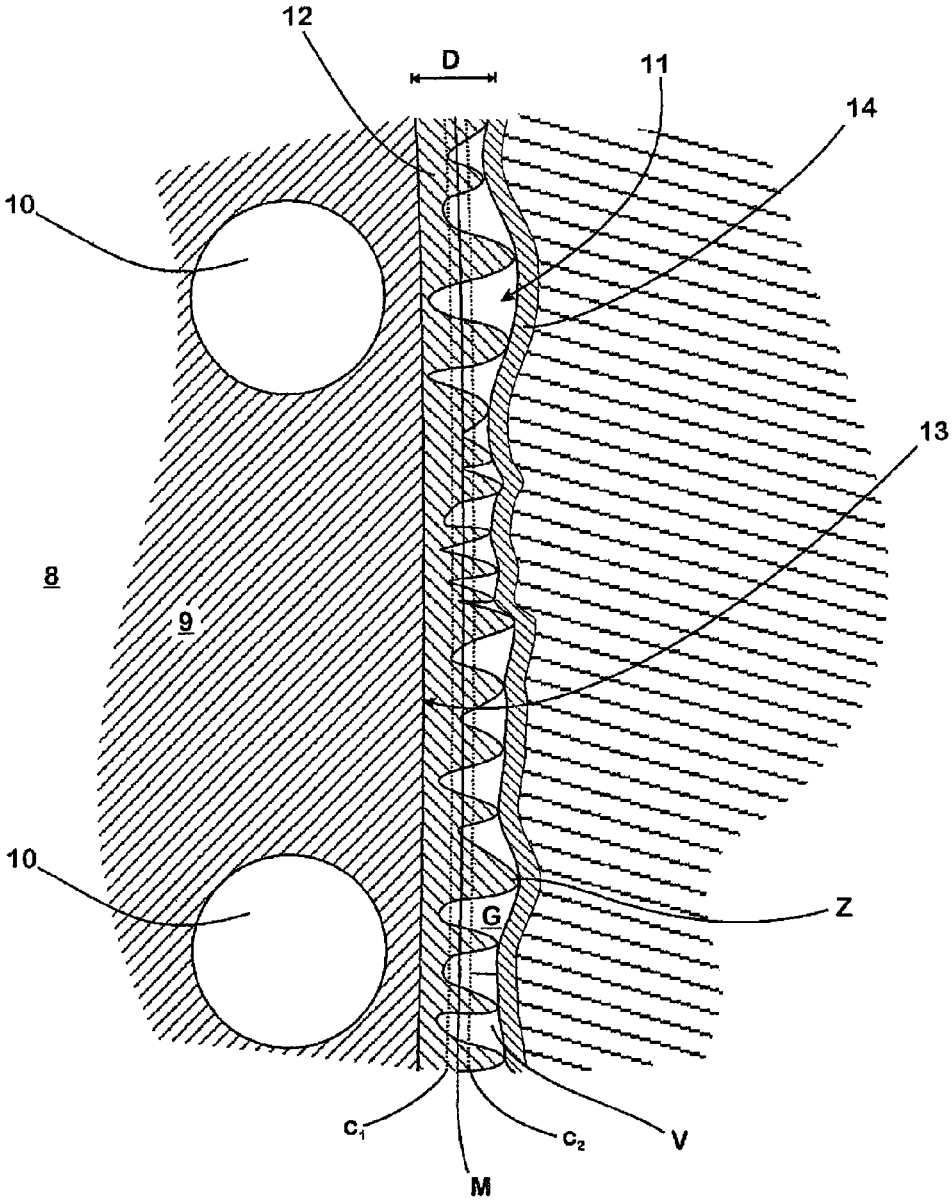
FIG. 2 The section A from FIG. 1 in a greatly enlarged sectional view.

The two-roll casting device 1 indicated in FIG. 1, in principle constructed in a conventional manner, for the casting of a steel melt S to a cast steel strip B, has two casting rolls 2, 3, arranged axially parallel to one another and rotating in counter-rotation to one another, which delimit the longitudinal sides of a casting gap 4 formed between them and of the melt pool 5 formed above, into which is introduced the steel melt S which is to be cast. The two lateral transverse sides of the casting gap 4, free of the casting rolls 2, 3, and of the melt pool 5, are in each case sealed by side sealing arrangements, not represented in detail here.

The cast steel strip B drawn from the casting gap 4 is conveyed in a likewise known manner via a conveying path 6 to a hot-rolling stand 7, in which it is continually hot-rolled to form a hot strip W with specific end thickness. The conveying path 6 in this context has a first section running essentially vertically emerging from the casting gap 4, which then merges in a curve into a second section, running essentially horizontally and leading to the hot-rolling stand 7. Arranged along the conveying path 6, in the usual manner, are cooling devices, not represented here, which can be used for the specific accelerated cooling of the cast strip B.

The casting rolls 2, 3 have in case a roll body 8, of which the casing 9 is made from a copper alloy. Formed into the casing 9 are cooling channels 10, through which cooling water flows during the casting operation in order to bring about intensive cooling of the casing surface 11 of the casting rolls 2, 3 which comes into contact with the melt S.

The casing surface 11 of the casting rolls 2, 3 is formed in each case by the free surface of a coating 12, which has been applied by flame-spraying in a known manner onto the casing surface 13 of the casing 9 of the roll body 8. The coating 12 can be formed, for example, from a hard metal alloy, such as tungsten carbide or a Cr—Ni alloy. The thickness D of the coating 12 amounts in this case to some 150 μm.

To apply the coating 12, the operating parameters of the flame spraying (granulation of the hard metal, flame temperature, flow speed of the gas flow, relative movement between roll and spray device) are adjusted in such a way that a surface structure is formed at the free casing surface 11 of the coating 12, with a roughness Ra, determined in accordance with StahlEisen SEP 1940, of less than 20 μm, and in which, corresponding to a number of peaks of 20 $cm^{-1}$ likewise determined in accordance with SEP 1940, at least 20 peaks Z are formed per centimetre. "Peaks Z" is understood in this situation to mean according to SEP 1940 such profile irregularities per length unit of the filtered profile of the coating 12, which one after another undercut a lower section line c2 and exceed an upper section line c1, wherein the two section lines c1, c2 are arranged parallel and symmetrically distanced from the mid-line M lying between them of the profile of the coating 12.

On the melt S coming in contact with the intensively cooled free casing surface 11 of the casting rolls 2, 3, intensive heat dissipation takes place by way of the peaks Z. In this situation a relatively large number of peaks Z per surface unit come into contact simultaneously with the melt S. As a consequence, there forms in the melt S a solidification front 14, progressing from the casing surface 11 of the casting rolls 2, 3 in the direction of the interior of the melt pool 5, which, because of the large number of contacts between the casing surface 11 and the melt, has a uniform thickness and microstructure. At the same time, the gas cushions G, enclosed in the troughs V which are present between the peaks Z, prevent the melt S from adhering to the casing surface 11. By the structuring of the casing surface 11 of the casting rolls 2, 3, in this way, on the one hand, an optimum casting result is provided, with an optimized microstructure and an optimum surface condition of the cast steel strip B, and, on the other, a more reliable operational sequence is assured. At the same time, the coating 12, providing, because of its high degree of hardness, a high resistance to wear and therefore a better service life of the casting rolls 2, 3 in relation to conventionally coated casting rolls.

REFERENCE FIGURES

Two-roll casting device
2, 3 Casting rolls
4 Casting gap
5 Melt pool
6 Conveying path
7 Hot-rolling stand
8 Roll body
9 Casing of roll body
10 Cooling channels
11 Casing surface of the coating 12
12 Coating
13 Casing surface of the roll body 9
14 Solidification front of the melt S
B Steel strip
c1, c2 Section lines
D Thickness of the coating 12
G Gas cushion
M Mid-line of the filtered profile of the coating 12
S Steel melt
V Troughs between the peaks Z
Z Peaks of the casing surface 11

The invention claimed is:

1. Casting roll for a two-roll casting device for the casting of metallic strip from a metal melt, the casting roll comprising a roll body having a coating on a casing surface of the roll body, wherein the coating material is applied by thermal spraying, which has a higher degree of hardness than the roll body, wherein a free surface of the coating, after the thermal spraying, has a peak number RPc of at least 10 $cm^{-1}$.

2. Casting roll according to claim 1, wherein the peak number RPc amounts to a maximum of 40 $cm^{-1}$.

3. Casting roll according to claim 1, wherein the thickness of the coating is at most 200 μm.

4. Casting roll according to claim 3, wherein the coating is 75-180 μm thick.

5. Casting roll according to claim 1, wherein the coating material includes hardness-enhancing ceramic particles.

6. Casting roll according to claim 1, wherein the coating material is formed from a hard metal alloy.

7. Casting roll according to claim 6, wherein the coating material includes tungsten carbide.

8. Casting roll according to claim 1, wherein the coating material includes a CrNi alloy.

9. Two-roll casting device for the casting of cast strip from a metal melt, with two rotating casting rolls arranged axially parallel and running in counter-rotation to one another, which delimit between them a casting gap, through which the cast strip emerges, wherein the casting rolls are formed according to claim 1.

10. Casting roll according to claim 1, wherein the peaks of the coating, after the thermal spraying, have a non-uniform height.

11. Casting roll according to claim 1, wherein the peaks of the coating, after the thermal spraying, have an irregular shape.

12. Casting roll according to claim 1, wherein the distances between adjacent peaks are indefinite.

13. A method of manufacturing metallic strip from a metal melt, the method comprising:

providing two rotating casting rolls arranged axially parallel and running in counter-rotation to one another, which delimit between them a casting gap, wherein the casting rolls are formed according to claim 1; and solidifying a metallic strip from the metal melt, wherein a cast strip emerges through the casting gap.

* * * * *